US006148565A

United States Patent [19]

Lancaster

[11] Patent Number: 6,148,565

[45] Date of Patent: Nov. 21, 2000

[54] ROOF ASSEMBLIES

[75] Inventor: John E. Lancaster, Lancashire, United Kingdom

[73] Assignee: Ultraframe Limited, Lancashire, United Kingdom

[21] Appl. No.: 09/190,687

[22] Filed: Nov. 12, 1998

Related U.S. Application Data

[63] Continuation-in-part of application No. 08/900,766, Jul. 25, 1997, abandoned.

[51] Int. Cl.[7] ..... E04B 1/00

[52] U.S. Cl. ..... 52/13; 52/18; 52/82; 52/90.1

[58] Field of Search ..... 52/11, 13–16, 52/18, 63, 66, 80.1, 82, 90.1, 97; 403/49, 170, 217, 218

[56] References Cited

U.S. PATENT DOCUMENTS

| | | | |
|---|---|---|---|
| 3,716,896 | 2/1973 | Seabourn et al. . | |
| 4,233,794 | 11/1980 | Mayer . | |
| 5,040,916 | 8/1991 | Morgan . | |
| 5,513,470 | 5/1996 | Vollebreft | 52/13 |
| 5,927,027 | 7/1999 | Richardson | 52/13 X |

FOREIGN PATENT DOCUMENTS

| | | | |
|---|---|---|---|
| 0 075 509 | 3/1983 | European Pat. Off. . | |
| 36 40 489A1 | 11/1986 | Germany . | |
| 9002093 | 4/1992 | Netherlands | 52/13 |
| 2 204 627A | 11/1988 | United Kingdom . | |
| 2 214 964A | 9/1989 | United Kingdom . | |
| 2 218 127A | 11/1989 | United Kingdom . | |
| 2 256 658A | 12/1992 | United Kingdom . | |
| 2 256 880A | 12/1992 | United Kingdom . | |
| 2 261 237A | 5/1993 | United Kingdom . | |
| 2 287 493A | 9/1995 | United Kingdom . | |
| 91/01419 | 2/1991 | WIPO . | |

*Primary Examiner*—Richard Chilcot
*Attorney, Agent, or Firm*—Quarles & Brady LLP

[57] ABSTRACT

A roof assembly for a hipped conservatory roof has a ridge end member and glazing bars mounted thereon via connectors, each connector having a first part mounted on the ridge end member and having a top surface and a second part connected to a glazing bar, wherein the top surface of the first part of the connector is channeled to provide a drainage passage from the connector to the glazing bar.

16 Claims, 7 Drawing Sheets

ROOF ASSEMBLIES

CROSS REFERENCES TO RELATED APPLICATIONS

This application is a continuation-in-part of U.S. patent application Ser. No. 08/900,766 filed on Jul. 25, 1997 now abandoned.

BACKGROUND OF THE INVENTION

This invention concerns roof assemblies, especially for conservatories.

It is known to construct conservatory roofs from polycarbonate roofing panels supported between glazing bars. The glazing bars are supported by and connected at one end to a ridge structure and at the other end are supported by and connected to an eaves structure. Such ridge structures comprise a pair of flanges which the glazing bars are supported on and connected to. A ridge capping is connected to the ridge structure and the ends of the glazing bars and roofing panels. The ridge capping comprises two downwardly extending flaps or wings which overlie the ridge structure and the ends of the glazing bars and roofing panels to provide such cover. The wings of the ridge capping are kept spaced apart from the roofing panels so as to define a passageway therebetween in order to allow ventilation of the ridge structure and consequently the interior of the conservatory.

Hipped conservatories have glazing bars extending from the ridge end radially. The flanges of the ridge structure are continued around an end thereof and the glazing bars are bolted thereto in appropriate positions. The angle of the flange is, of course, fixed and so affords no flexibility in erection of the conservatory.

It is known, from GB 2261237A, to provide a ridge end plate with a rim around its periphery, on which are fitted connectors to glazing panel support members. The connectors engage the rim at a predetermined angle. However, that arrangement makes no allowance for dealing with water ingress in the region of the connectors.

SUMMARY OF THE INVENTION

An object of this invention is to provide an improved conservatory ridge structure.

According to this invention there is provided a roof assembly for a hipped conservatory roof having a ridge end member and glazing bars mounted thereon via connectors, each connector having a first part mounted on the ridge end member and having a top surface and a second part connected to a glazing bar, wherein the top surface of the first part of the connector is channeled to provide a drainage passage from the connector to the glazing bar.

The top surfaces of the connectors have along their side edges grooves receiving sealing strips. Thus, glazing panels supported on the glazing bars can be extended further into the ridge and any water that drips between glazing panels in the region of a connector is contained by the drainage channel in the top surface of the container and drains off onto a glazing bar and hence down the roof to guttering.

The glazing bars are preferably mountable on the ridge end at different angles relative thereto. The preferred ridge end member has a rim on which the connectors are securable. The connectors preferably have separable parts whereby the rim of the ridge end member can be gripped between them. In one preferred embodiment, the separable parts slide together and in another preferred embodiment the separable parts are hingedly connected. Alternatively, the two parts may be secured together by additional securing means. Thus, whether the two parts are interconnected in any way, for clamping to a ridge end member, the two separable parts of the connector may be secured together by any suitable means, such as a bolt or the like through the two parts.

The rim of the ridge end is preferably of a circular cross-section and the connector parts preferably have lateral grooves therein corresponding in section to a part of the rim. Either or both of the rim and the connector parts grooves may be profiled to provide grip therebetween. Preferably either or both of the rim and grooves have surface serration.

Preferably glazing bars are attachable to the connectors by engagement of suitably shaped parts of the connectors with glazing bars. Preferably glazing bars are slidably engageable with parts of the connectors.

Preferred glazing bars are of the type which are the subject of our co-pending U.K. Patent Application No. 9402179.7. These are of generally inverted T-section and so the connectors preferably have a slot for receiving the stem of a T-section glazing bar. The connectors preferably further have flanges to either side of the slot to engage returned ends of glazing bar flanges. Preferably ends of the flanges of the connectors are enlarged to provide grip.

The glazing bars used in the invention may have ducted stems, in which case it is desirable for connectors to have projections that can engage in said ducts. A screw or the like through the stem side into a projection or alternatively through a part of the connector into a screw port of the glazing bar may further secure a glazing bar to a connector.

The connectors may also have through holes in a forward end thereof, whereby the connectors can be affixed to a ridge end other than between their separable parts.

The preferred ridge end used in the invention is an aluminum casting and the connectors are preferably plastics moldings.

BRIEF DESCRIPTION OF THE DRAWINGS

This invention will now be further described, by way of example only, with reference to the accompanying drawings, in which.

DETAILED DESCRIPTION OF THE INVENTION

Figure 1:
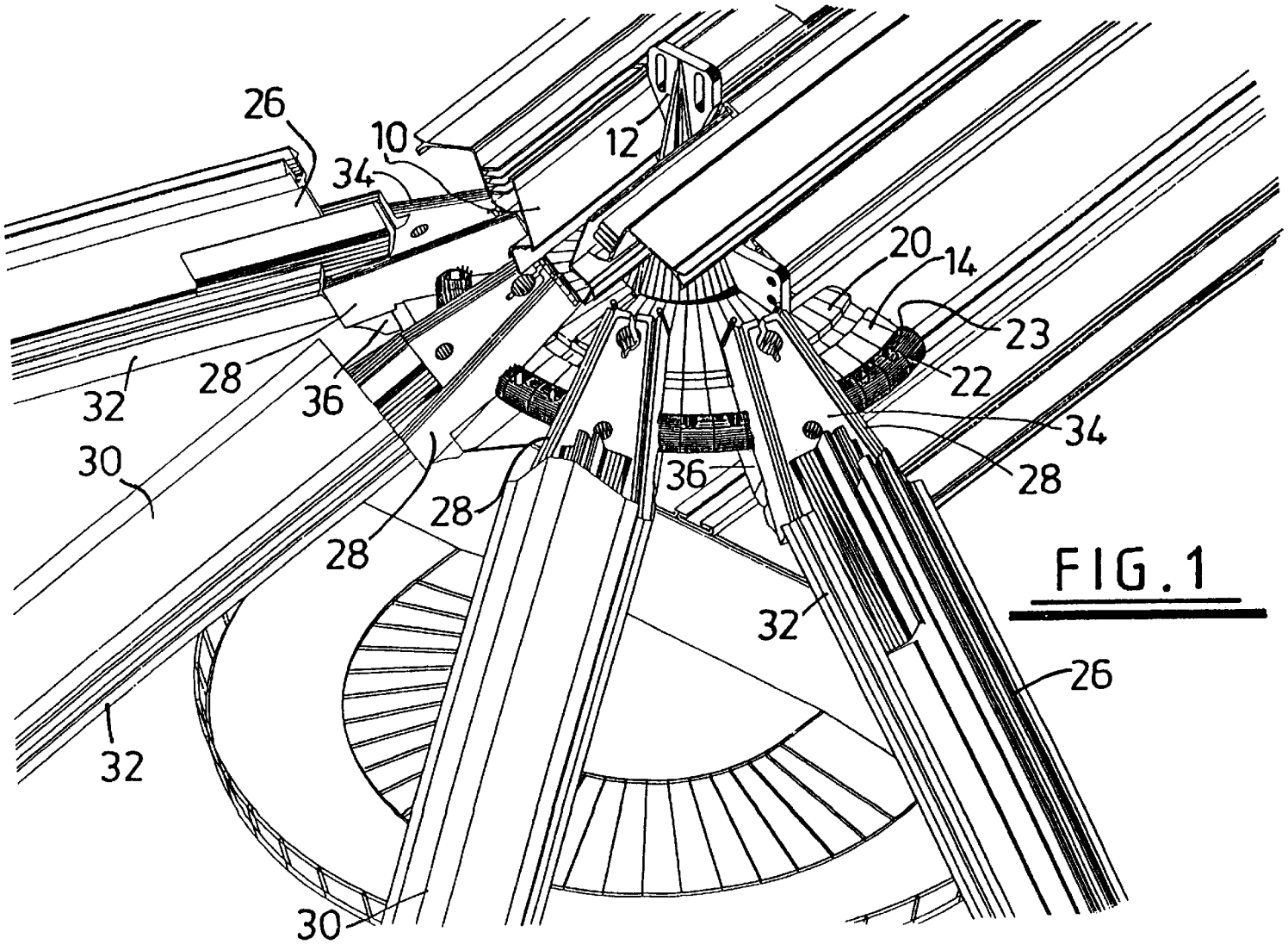
FIG. 1 shows a hipped conservatory roof ridge end.

Referring to the accompanying drawings, a hipped conservatory roof ridge end comprises an extruded aluminum ridge member 10, which is described in detail in our co-pending U.K. Patent Application No (our file P3511). The ridge member base is cut back from one end thereof to receive post part 12 of a cast aluminum ridge end 14. The post 12 has extending rearwardly a lug 16 with a through hole 18, whereby the ridge end 14 can be secured by means of a nut and bolt (not shown) to the ridge member base.

The ridge end 14 has at the base of the post 12 a skirt 20 which extends slightly more than a semicircle about the post 12 and is generally perpendicularly to the post 12. At its periphery the skirt 20 has a circular section rim 22 with a series of holes 23 therethrough at right angles to the skirt 20. The rim 22 has a serrated surface, the serrations 24 running in an axial direction of the rim 22.

Glazing bars 26 are connected to the rim 22 of the ridge end 14 by means of two part connectors 28. Roofing panels (not shown), such as of polycarbonate, are supported on the glazing bars 26 and held in place by upper and lower cappings 30, 32. This arrangement is described in detail in our co-pending U.K. Pat. Application No. 9402179.7

The connectors 28 have upper and lower parts 34 and 36 respectively that slide together by a tongue and groove arrangement whereby the spacing therebetween can be adjusted. The two parts 34, 36 together act as a clip which fits around the rim 22 of the ridge end 14. The upper part 34 of the connector 28 has a groove 38 in its underside corresponding to the shape of the rim 22 and the lower part 36 of the connector has a groove 40 in its topside also corresponding to the rim 22. The lower part 36 has at one end groove 42 and the upper part 34 has a stepped portion 44 formed as a tongue 46 to provide the aforesaid tongue and groove arrangement.

Figure 9:
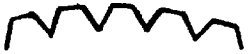
FIG. 9 shows serrations of a connector or a ridge end component.
Figure 8:
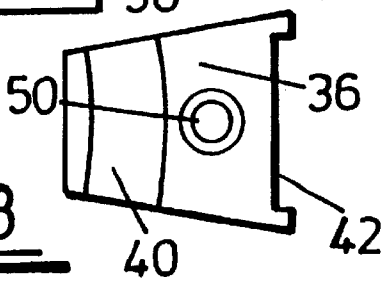
FIG. 8 is a plan view of the other part of the connector of FIG. 4.
Figure 4:
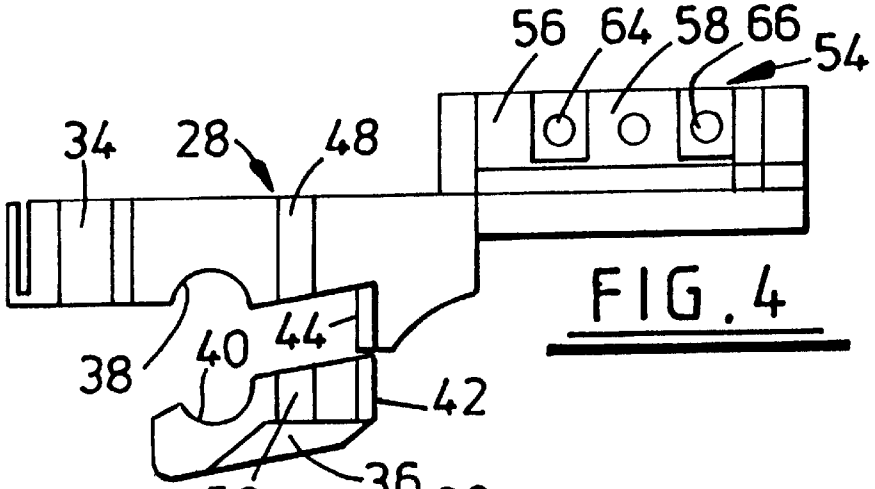
FIG. 4 is a side view of a two part glazing bar connector for connection thereof to the ridge end component of FIG. 3.
Figure 5:
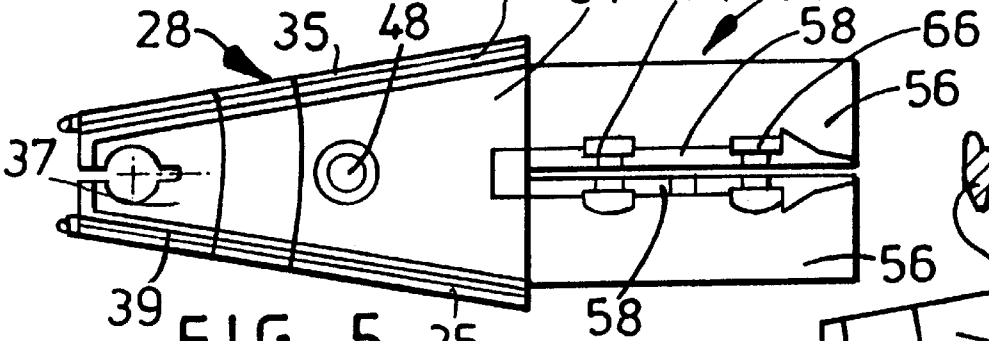
FIG. 5 is a plan view of the connector of FIG. 4.

The two parts of the connector each have through holes 48, 50 respectively which are generally aligned when the two parts are together to receive a nut and bolt or the like for securing them together. The surface of each groove 40, 42 is serrated as shown in FIG. 9 to provide grip when mounted on the serrated rim 22 of the ridge end 14.

The upper part 34 of the connector 28 has a rearwards extension 54 comprising a pair of spaced parallel generally L-shaped members 56 in a back-to-back arrangement. The members 56 have first limbs 58 that together provide a slot to receive a glazing bar 26. The glazing bars 26 are generally of inverted T-section which provides a pair of flanges which are turned back on themselves at their remote ends and an upstanding limb which is bifurcated to form an upwardly open channel for receiving the upper capping. The L-section members 56 have second limbs 60 extending outwardly and slightly downwardly with enlarged edge formations 62. These edge formations slide into the returned ends of the glazing bar flanges. To secure the glazing bars 26 to the upper connector parts 34, holes 64, 66 are provided through both members 56 to take nuts and bolts through them and the glazing bars.

The upper part 34 of the connector 28 has a top surface with raised side edges 35. The side edges 35 are grooved along their length. The raised side edges 35 create a channel 37 along the top of the connector in the direction of its glazing bar. The grooves 39 in the side edges are to receive rubber or elastomeric sealing strips (not shown). The presence of the sealing strips allows the glazing panels supported on the glazing bars to be extended further towards the ridge end. Gaps between adjacent glazing panel edges will overlie the channels 37 so that any water penetrating those gaps falls into the channels and drains towards the glazing bars, which themselves act as drainage passageways carrying water down to guttering.

The glazing bars 26 can, with the above arrangement, be secured to the ridge end at different angles by altering the spacing between the upper and lower connector parts 34, 36 to allow the glazing bar 26 to be pivoted into position and then securing the two connector parts together to grip around the rim 22 of the ridge end 14. The serration 24 of the rim 22 of the ridge end 14 and the grooves 40, 42 of the connector parts 34, 36 provide additional securement.

The ridge end 14 can also have glazing bars 26 secured directly thereto particularly for a flat roof arrangement by using the through holes 23 of the rim 22 to take securing bolts for the glazing bars 26.

Figure 2:
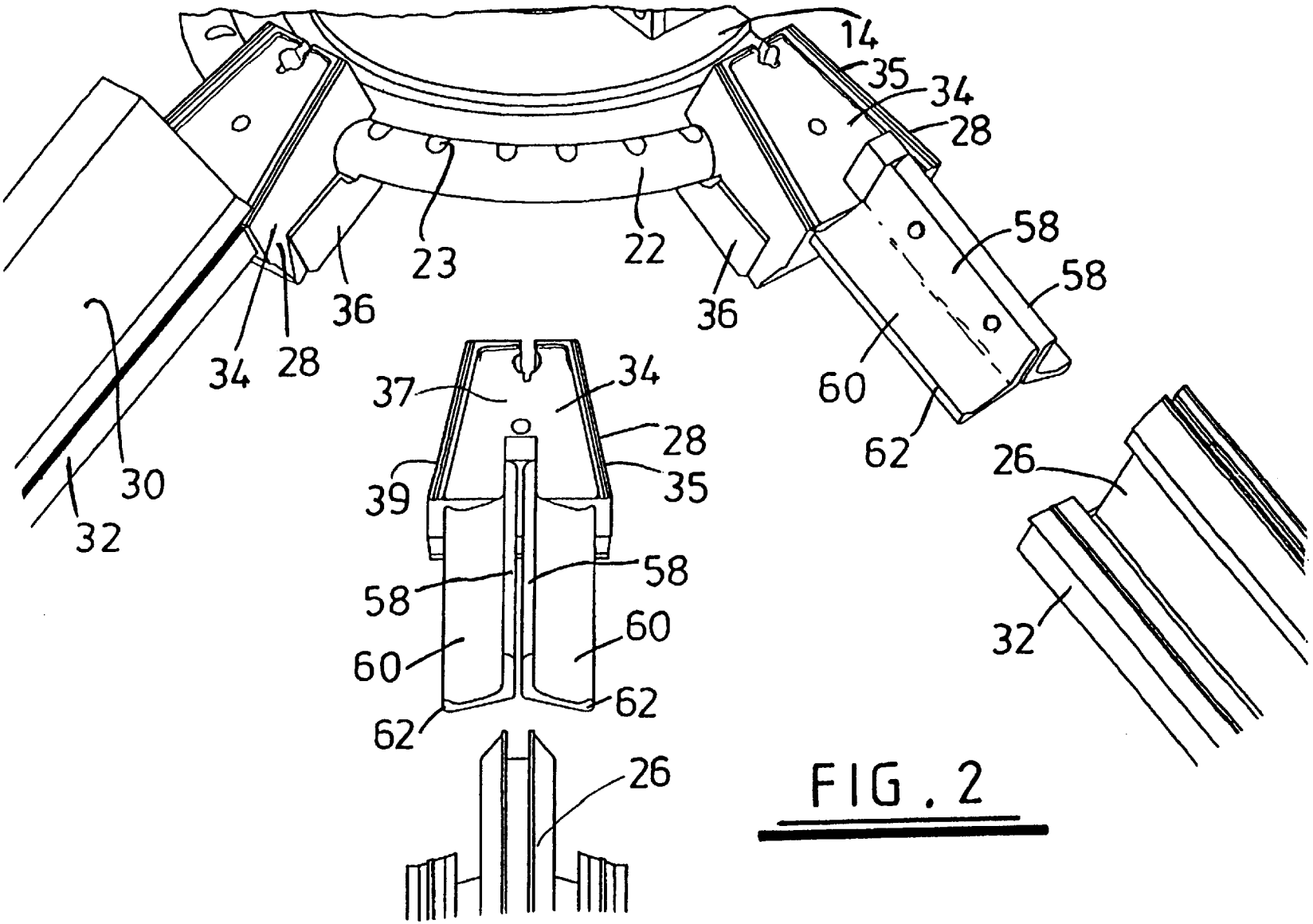
FIG. 2 is another view of the roof ridge end of FIG. 1 partially assembled.
Figure 2A:
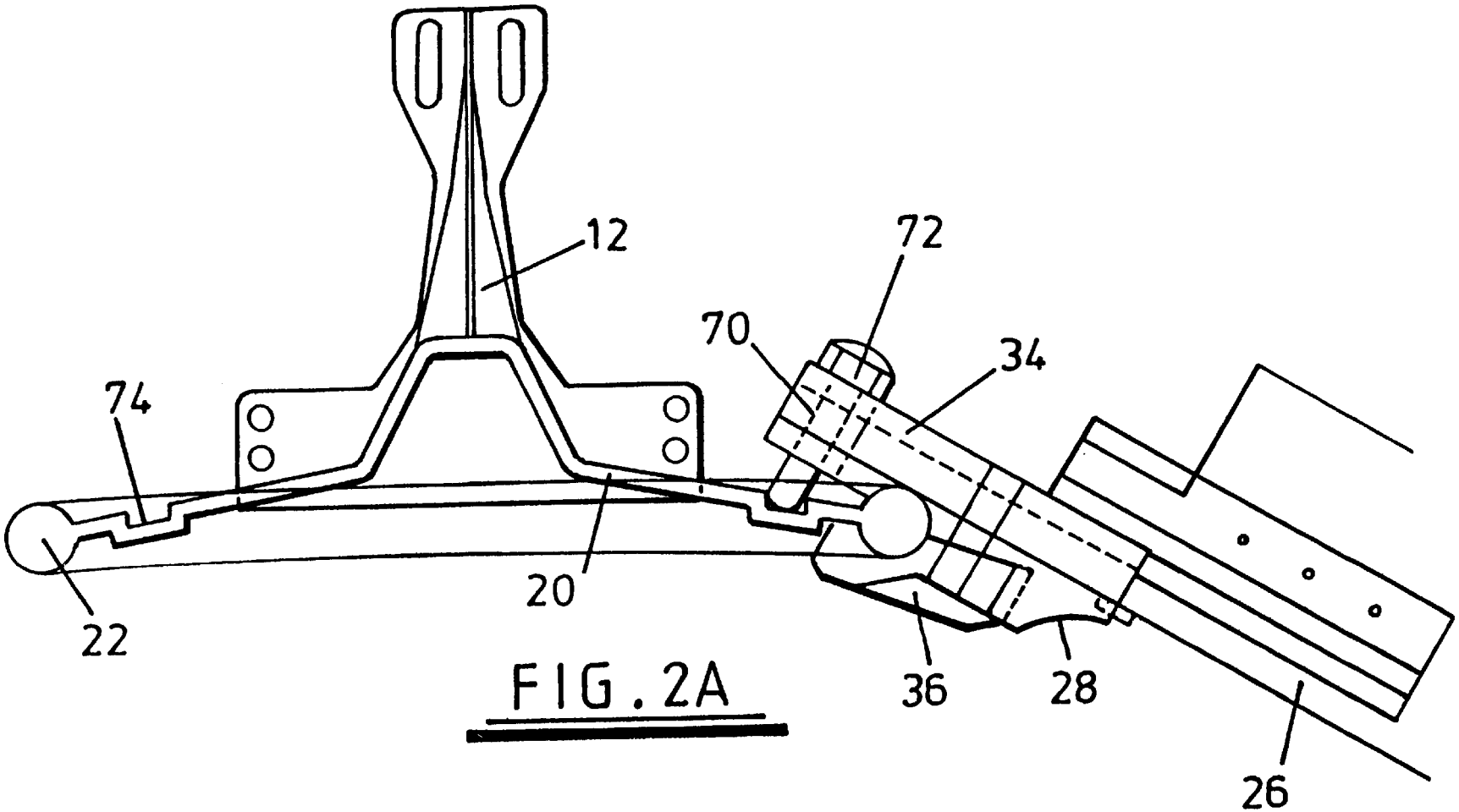
FIG. 2A is a rear view of the roof ridge end of FIG. 1 with only one glazing bar attached.

Each connector 28 also has a screw hole 70 at its forward end. This hole takes a locking screw 72 as shown in FIG. 2A, which can locate in groove 74 in the surface of the skirt 20 of the ridge end. The locking screw when screwed down into the groove provides additional security for the connection but can also serve to hold the connector and hence glazing bar in position whilst the other end of the glazing bar is connected to an eaves beam and before the connector is tightened onto the ridge end.

Figure 3B:
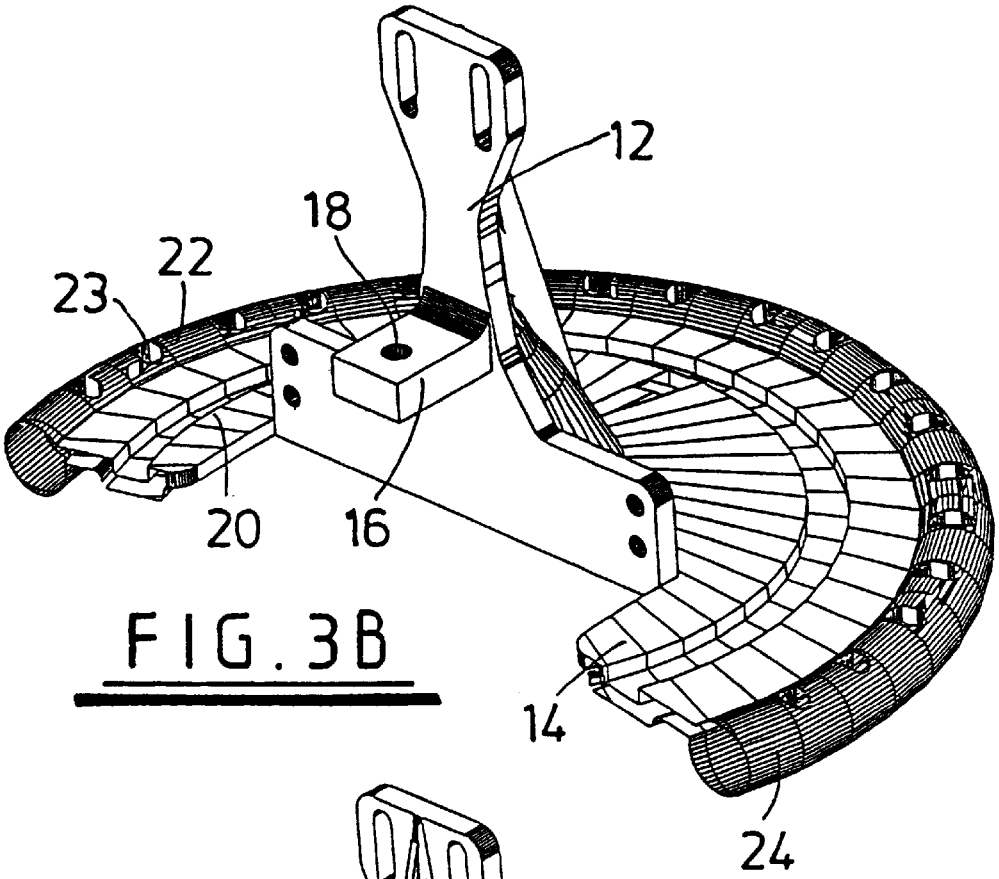
FIGS. 3A and 3B are opposed views of a ridge end component.
Figure 3A:
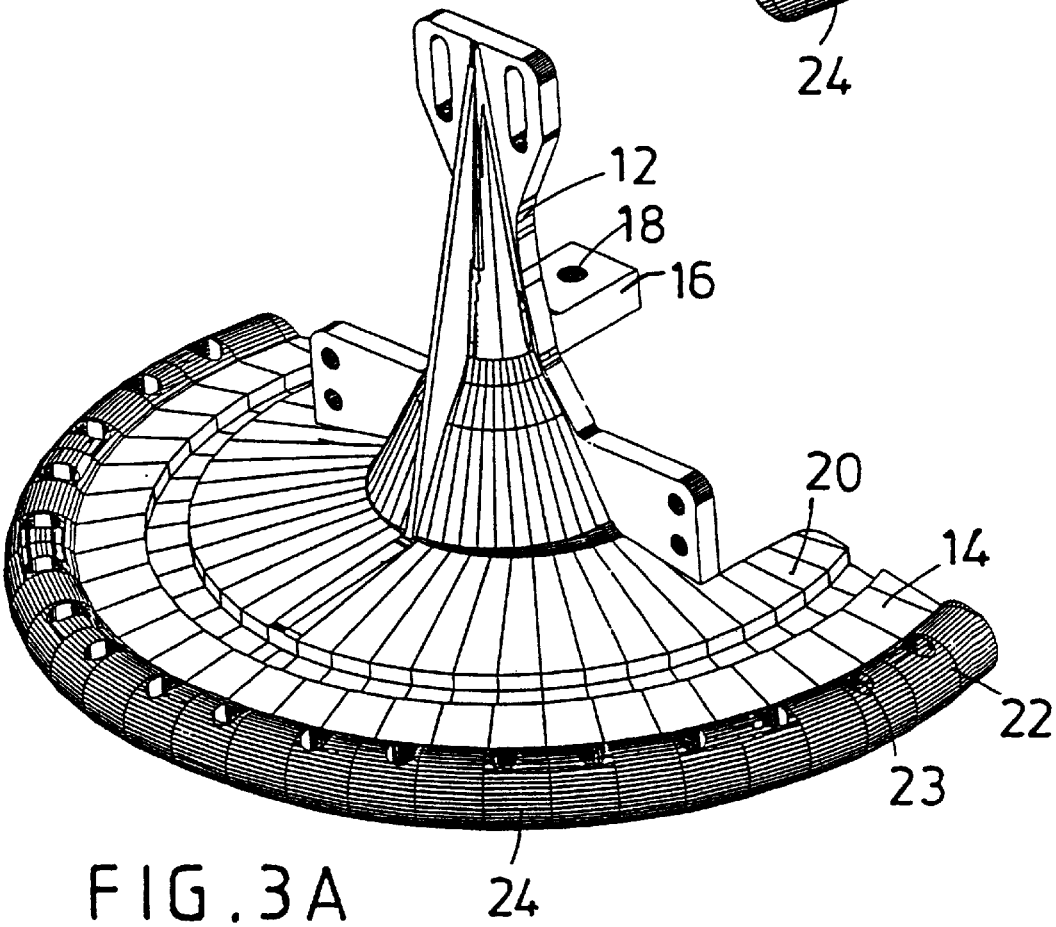
Figure 6:
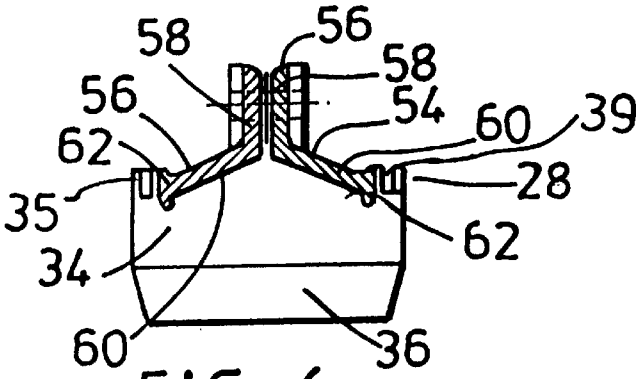
FIG. 6 is a rear elevation of one part of the connector of FIG. 4.
Figure 7:
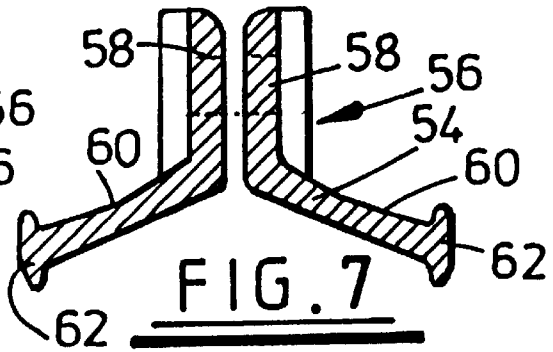
FIG. 7 shows detail of the connector of FIG. 4.

Turning to FIGS. 10 to 15 of the accompanying drawings, a ridge end arrangement is shown in which glazing bars 100 are of a type having a ducted stem 102 with a screw port 103 at or near a lower end of the stem. The ducted stem gives the glazing bars 100 more stability against twisting. The glazing bars 100 have cross bars 105 extending either side of the stem with end returns 106. Connectors 107 for securing the glazing bars 100 to a ridge end 108 (which is the same as in FIG. 3A and B) have been designed to suit the ducted glazing bars 100.

The connectors 107 are still in two parts, namely an upper part 109 and a lower part 110 (not shown in FIGS. 12 to 15). The two parts are held together by a bolt (not shown) through aligned holes of the two parts. The hole through the upper part 109 can be seen at 112. The upper and lower parts each have a lateral groove 114 and 116 respectively that together form a generally circular section slot for clamping onto the ridge end rim 122. The through bolt is loosened to fit the connector to the rim 122 and then tightened to secure the connector in place. As in previous embodiments, the surfaces of the grooves may be serrated to provide additional grip on the ridge end rim.

The upper connector part 109 has a generally flat top surface 111 and formations at one end for engaging a glazing bar of inverted T-section type, the stem of which is ducted. Those formations comprise a pair of extensions 118 that are shaped to fit either side of a glazing bar each having one upwardly directed part 124, which together form a gap into which the stem of the glazing bar is a sliding fit and a laterally extending part 126, each of which fits into the glazing bar cross bar 105 on one side of the stem.

The connectors 107 further have an upstand 128 from their top surface 111 which has side walls 130 and an end wall 132. From the opposite side of the end wall 132 is a projection 134 which is shaped so as to fit into the duct of a glazing bar stem. The end wall 132 also has a hole 136 through it positioned to align with the screw port of a glazing bar so that the two can be fastened together by means of a screw (not shown).

Figure 10:
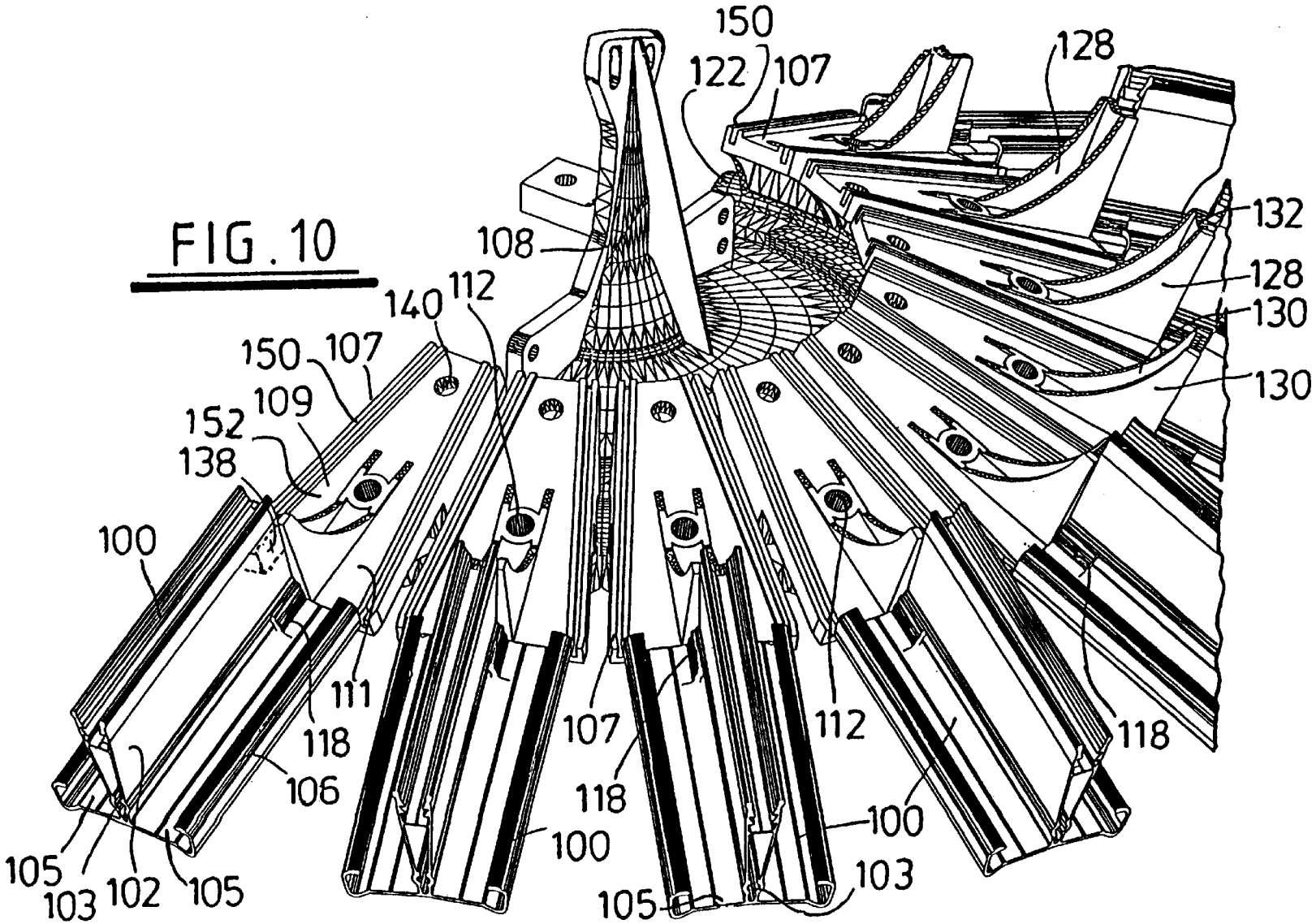
FIG. 10 shows another form of hipped conservatory roof ridge end.
Figure 14:
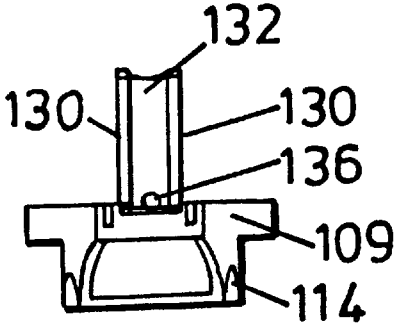
FIG. 14 is a front elevation of a top part of the connector of FIG. 11.
Figure 15:
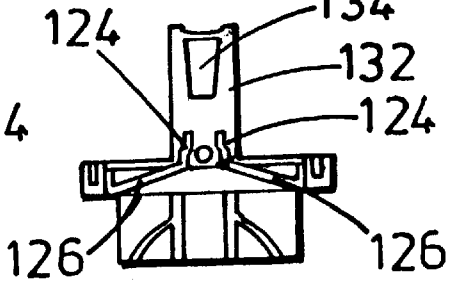
FIG. 15 is a rear elevation of a top part of the connector of FIG. 11.
Figure 11:
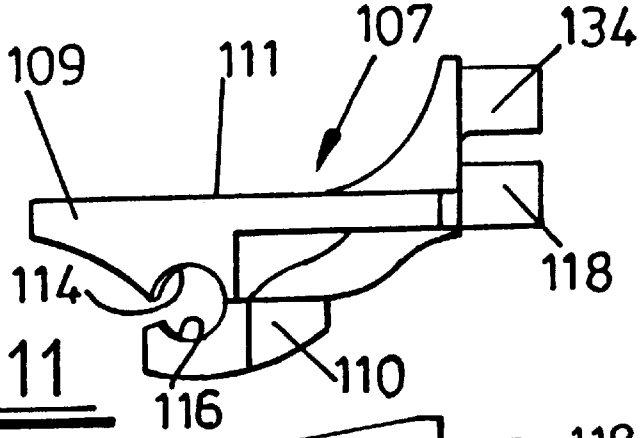
FIG. 11 is a side elevation of a connector used in forming the ridge end of FIG. 10.
Figure 12:
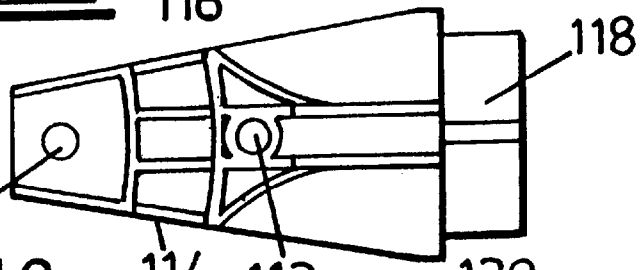
FIG. 12 is an underside plan view of the connector of FIG. 11.
Figure 13:
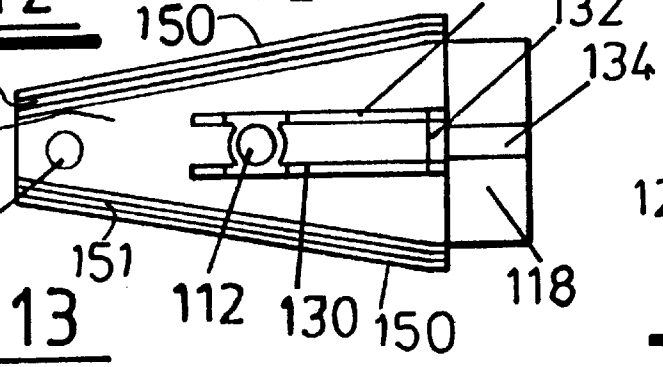
FIG. 13 is a top plan view of the connector of FIG. 11.

Alternatively, as indicated at 138 in FIG. 10, a screw can be fitted through the side of a glazing bar stem into a projection 134 to fasten the glazing bar to the connector.

The top connector part 109 also has a through hole 140 at its forward end which may be used to take a locking screw in the same way as described with reference to FIG. 2A of the drawings.

The top connector part 109 has a top surface that has raised side edges 150. The side edges are grooved 151 to receive rubber or elastomeric sealing strips. The provision of the raised side edges forms channels 152, which serve the same purpose as the channels 37 of the connectors shown in the previous illustrated embodiment.

It will be appreciated that other forms of glazing bar may be used in the invention. All that is required is for the connectors to be provided with appropriate formations and/or fixing means to secure the glazing bars to the connectors.

What is claimed is:

1. A roof assembly for a hipped roof having a ridge end member and glazing bars mounted thereon via connectors, each connector having a first part mounted on the ridge end member and having a top surface and a second part connected to a glazing bar, wherein the top surface of the first part of the connector is channeled to provide a drainage passage from the connector to the glazing bar.

2. A roof assembly as claimed in claim 1, wherein the connector top surface has along side edges grooves receiving sealing strips.

3. A roof assembly as claimed in claim 1, wherein the glazing bars are mountable on the ridge end at different angles relative thereto.

4. A roof assembly as claimed in claim 1, wherein the ridge end has a rim on which the connectors are securable.

5. A roof assembly as claimed in claim 4, wherein the connectors have separable parts whereby the rim of the ridge end may be gripped between them.

6. A roof assembly as claimed in claim 5, wherein the separable parts of the connectors are hingedly connected.

7. A roof assembly as claimed in claim 5, wherein the separable parts of the connectors are slidably connected.

8. A roof assembly as claimed in claim 5, wherein the two connector parts are secured together by means of a bolt through the two parts.

9. A roof assembly as claimed in claim 4, wherein the rim of the ridge end is of circular cross section.

10. A roof assembly as claimed in claim 9, wherein the connector parts have lateral grooves therein corresponding in section to a part of the rim of the ridge end.

11. A roof assembly as claimed in claim 10, wherein the connector grooves are profiled to provide grip.

12. A roof assembly as claimed in claim 10, wherein at least one of the rim and connector grooves have surface serrations.

13. A roof assembly as claimed in claim 1, wherein the glazing bars are attached to the connectors by engagement of cooperating parts.

14. A roof assembly as claimed in claim 13, wherein glazing bars are slidably engageable with parts of the connectors.

15. A roof assembly as claimed in claim 1, wherein the glazing bars are of inverted T-section and the connectors have slots for receiving the stems of the T-sections.

16. A roof assembly as claimed in claim 1, wherein the glazing bars are of inverted T-section, the stems of which are hollow and the connectors have projections for engaging in said bottom stems.

* * * * *